United States Patent [19]

Abe

[11] Patent Number: 4,903,565

[45] Date of Patent: Feb. 27, 1990

[54] AUTOMATIC MUSIC PLAYING APPARATUS

[75] Inventor: Yasunao Abe, Hamamatsu, Japan

[73] Assignee: Yamaha Corporation, Hamamatsu, Japan

[21] Appl. No.: 293,437

[22] Filed: Jan. 4, 1989

[30] Foreign Application Priority Data

Jan. 6, 1988 [JP] Japan ..... 63-1036

[51] Int. Cl.[4] ..... G10H 1/42; G10H 7/00

[52] U.S. Cl. ..... 84/611; 84/477 R; 84/DIG. 12

[58] Field of Search ..... 84/1.01, 1.03, 1.28, 84/477 R, 478, DIG. 12

[56] References Cited

U.S. PATENT DOCUMENTS 4,622,877 11/1986 Strong ..... 84/1.01

4,683,793 8/1987 Deutsch ..... 84/1.01

FOREIGN PATENT DOCUMENTS 60-25791 6/1985 Japan .

*Primary Examiner*—Stanley J. Witkowski

*Attorney, Agent, or Firm*—Spensley Horn Jubas & Lubitz

[57] ABSTRACT

The present invention provides an automatic music playing apparatus for automatically playing music, the music being composed of consecutive segments. The apparatus is essentially composed of (a) a memory device for storing musical data corresponding to the segments; (b) a control unit to read the musical data of the segments in a predetermined order and start reading data of a preselected segment consecutive to the segment being read according to an instruction therefor; and (c) a musical tone generator for generating musical tone according to the musical data read by the control means.

13 Claims, 12 Drawing Sheets

| | | | |
|---|---|---|---|
| TIMING DATA | MARK | TIME DATA TIMD | |
| DEPRESS KEY DATA | MARK | KEY CODE KC | KEY TOUCH KTD |
| RELEASE KEY DATA | MARK | KEY CODE KC | – |
| TONE COLOR DATA ETC. | MARK | TONE COLOR, EFFECTS DATA | |
| BAR CODE | BAR CODE | | |
| END CODE | END CODE | | |

AUTOMATIC MUSIC PLAYING APPARATUS

BACKGROUND OF THE INVENTION

1. Field of the Invention

The present invention relates to an automatic music playing apparatus for automatically playing music while reading play data out of memory. More particularly, the invention relates to such an automatic music playing apparatus using a memory of reduced size.

2. Prior Art

Repetitive phrases or segments are generally included in a piece of music. In a conventional automatic music playing apparatus, identical play data for each of the representative phrases is individually stored in a memory. For example, when the same phrase or segment is repeated three times, identical play data is thrice written in different locations of the memory.

An automatic music playing apparatus has been proposed in Japanese Patent Publication (examined) No. 60-25791 entitled "Electric Musical Instrument", in which automatic playing is performed by repeatedly reading the same play data out of memory. Specifically, when it is desired to repeatedly play a certain segment, a switch is depressed to read play data of the segment out of memory. In the conventional apparatus, although play data for all the repetitive segments are not stored in the memory, automatic music play can be performed.

In this apparatus, however, a memory reading address changes instantaneously upon depression of the switch, so it has been required that the switch depression be performed in exact coincidence with the beginning of a bar line of a score. In practice, however, such timing is extremely difficult.

SUMMARY OF THE INVENTION

In light of the foregoing circumstances, it is an object of the invention to provide an automatic music playing apparatus in which with only approximate switch manipulation, play data stored in part of a memory can be repeatedly played, and thereby reduce the size of the memory storing such data when playing music containing repetitive segments.

In order to achieve the above and other objects, according to one aspect of the invention, there is provided an automatic music playing apparatus for automatically playing a piece of music in accordance with play data, said piece of music being composed of a predetermined number of consecutive segments, said apparatus comprising:

- a storage means for storing said play data of at least one predetermined segment in a storage region having a predetermined number of storage locations assigned addresses;
- a reading means for sequentially reading said play data out of said storage means while addressing said storage locations;
- a musical tone generating means for generating musical tones in accordance with said play data read out by said reading means;
- a specifying means for specifying said storage region when activated;
- a detecting means for detecting a forthcoming segment of said piece of music being played after activation of said specifying means; and
- an address changing means for changing said address to a first address of said storage locations so as to resume addressing of said storage locations of said storage region specified by said specifying means at the time when said forthcoming is detected by said detecting means.

According to another aspect of the invention, there is provided an automatic music playing apparatus for automatically playing a piece of music in accordance with play data, said piece of music being composed of a predetermined number of consecutive segments, said apparatus comprising:

- a storage means for storing said play data of at least one predetermined segment in a storage region having a predetermined number of storage locations assigned addresses;
- a reading means for sequentially reading said play data out of said storage means while addressing said storage locations;
- a musical tone generating means for generating musical tones in accordance with said play data read out by said reading means;
- an operation means adapted to be activated;
- a detecting means for detecting a forthcoming segment of said piece of music being played after activation of said operation means; and
- an address changing means for changing said address to a predetermined address at the time when said forthcoming segment is detected by said detecting means.

In accordance with the first aspect of the invention, when the storage region is specified by the specifying means, the play of the current segment is continued until the subsequent segment has come. Upon detection of the subsequent segment, the automatic playing returns to a leading address location of the storing region and the playing is resumed from the location.

In accordance with the second aspect of the invention, when the operation means is activated, the play of the current segment is continued until the subsequent segment arrives. Upon detection of the subsequent segment, the address is changed to the predetermined address, and the automatic playing is resumed from the predetermined address.

BRIEF DESCRIPTION OF THE DRAWINGS

FIGS. 4 through 11 are flowcharts showing various programs of a CPU, in which FIG. 4 is a flowchart showing a main routine;

FIG. 5 is a flowchart showing a key/timbre event routine;

FIG. 6 is a flowchart showing rhythm-interruption processing:

FIG. 7 is a flowchart showing a rhythm-stop routine;

FIG. 8 is a flowchart showing an auto-play write routine;

FIG. 9 is a flowchart showing an auto-play read routine;

FIG. 10 is a flowchart showing bank-switch processing;

FIG. 11 is a flowchart showing a read auto-play data reading routine;

DETAILED DESCRIPTION OF THE PREFERRED EMBODIMENTS

Figure 1:
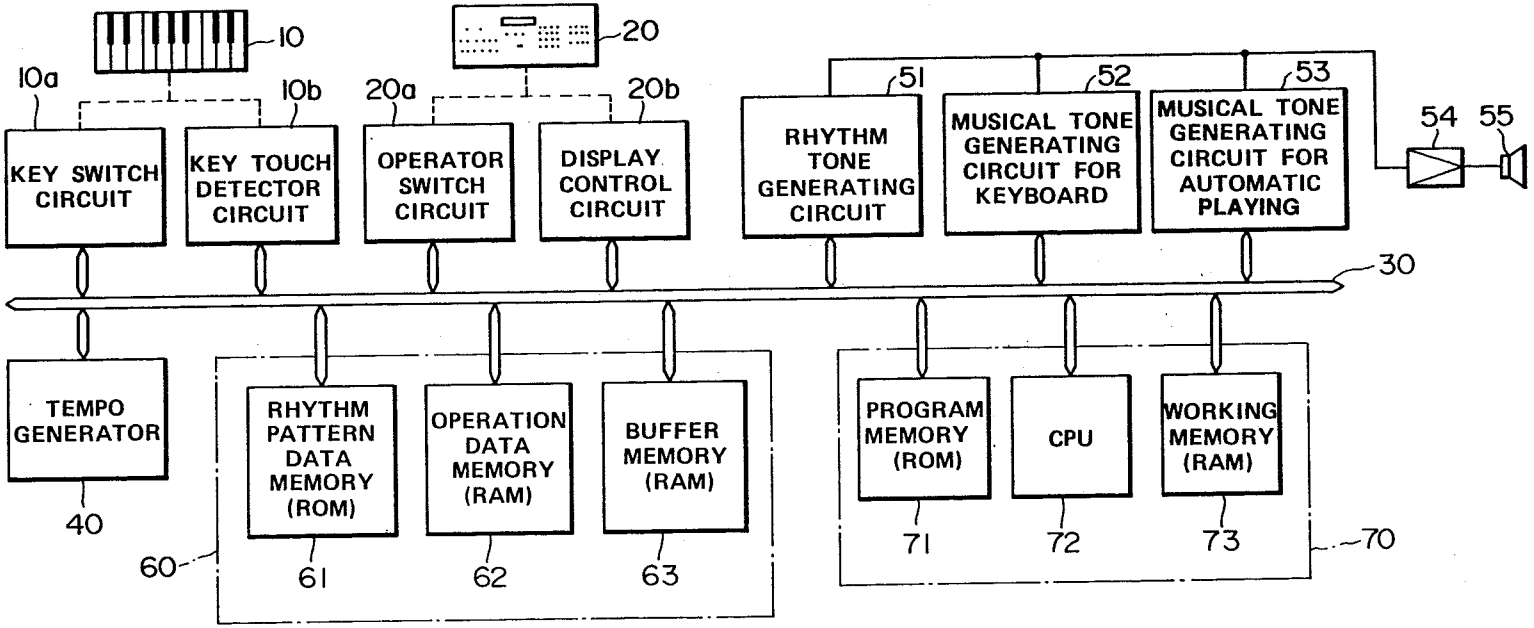
FIG. 1 is a block diagram showing an arrangement of a first embodiment of the present invention.

A first embodiment of the present invention will be described with reference to the accompanying drawings. FIG. 1 is a block diagram showing an arrangement of an electronic musical instrument provided with an automatic playing apparatus.

The electronic musical instrument has a keyboard 10 and an operation panel 20. The keyboard 10 is composed of a plurality of keys, each specifying a musical tone. Depression and release of each key are detected by the opening and the closing of an associated key switch provided in a key switch circuit 10*a*. A plurality of key touch sensors are provided in a key-touch detecting circuit 10*b* in association with the keys, each of the key-touch sensors is operated in response to the depression of the associated key. With such key-touch sensors, initial key-touch data is detected, such as key-depression speed and key-depression pressure. The key switch circuit 10*a* and the key-touch detecting circuit 10*b* are coupled to a bus 30.

Figures 2, 3:
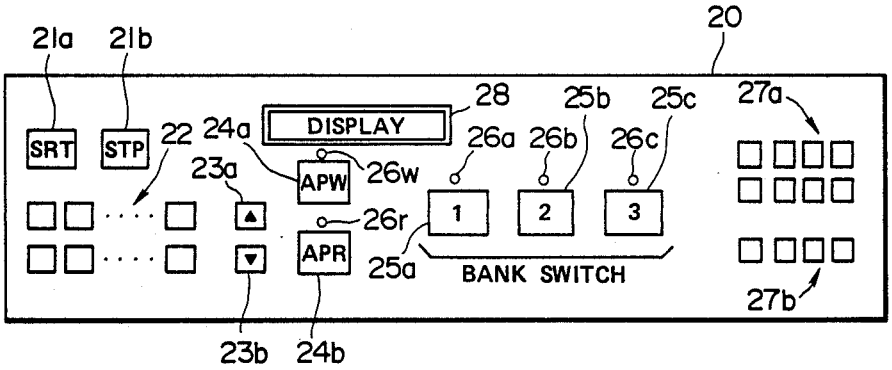
FIG. 2 is a schematic diagram showing an arrangement of an operation panel according to the first embodiment of this invention.
FIG. 3 is a diagram showing various data and codes used in the first embodiment of this invention.

As shown in FIG. 2, various kinds of buttons (described below) are arranged on the operation panel 20. Rhythm start button 21*a* and rhythm stop button 21*b* are provided to start and to stop the auto-rhythm, respectively. Rhythm selection buttons 22 are provided for selecting a rhythm, such as, for example, a march, a waltz or the like. Up button 23*a* and down button 23*b* are provided to increase and decrease the auto-rhythm tempo, respectively. Auto-play write button 24*a* and auto-play read button 24*b* are provided for instructing recording commencement and playing commencement of automatic play data. Bank switches 25*a*, 25*b* and 25*c* are for designating memory locations (bank) of a play data memory 62. LEDs (light emitting diodes) 26*w* and 26*r* are disposed immediately above the buttons 24*a* and 24*b*, respectively. Other LEDs 26*a*, 26*b* and 26*c* are disposed immediately above the bank switches 25*a*, 25*b* and 25*c*, respectively. Timbre buttons 27*a* and effect buttons 27*b* are arranged on the right side of the operation panel 20 for imposing timbre (or tone-color) and effect on musical tone, respectively. A display unit 28 is further arranged on the operation panel 20. Manipulations of these buttons are detected by a plurality of button switches provided in a button switch circuit 20*a* in association with the buttons on the operation panel 20. The display unit 28, LEDs 26*a* through 26*c*, 26*w* and 26*r* are subject to display control by a display control circuit 20*b*. The button switch circuit 20*a* and the display control circuit 20*b* are coupled to the bus 30.

Also coupled to the bus 30 are a tempo oscillator 40, a rhythm tone signal generating circuit 51, a keyboard musical tone signal generating circuit 52, an automatic play musical tone signal generating circuit 53, a data storage circuit 60 and a microcomputer 70. The tempo oscillator 40 supplies a tempo clock signal serves as a rhythm interruption signal which is dependent upon the tempo as instructed. The rhythm tone signal generating circuit 51 is provided with a plurality of percussion tone signal producing circuits, each of which generates a percussion tone of a percussion instrument, such as cymbals, or a bass drum. The percussion tone signal is generated in response to rhythm pattern data supplied from the microcomputer 70 via the bus 30. Both the keyboard musical tone signal generating circuit 52 and the automatic play musical tone signal generating circuit 53 are provided with a plurality of tone signal generating channels for generating tone signals corresponding to tones of musical instruments, such as a piano, or a violin. On the basis of the play data supplied from the microcomputer 70 via the bus 30, the keyboard tone signal generating circuit 52 geenerates a tone signal in accordance with the depression and release of the key on the keyboard 10, manipulations of the timbre buttons 27*a* and the effect buttons 27*b*. The automatic play tone signal generating circuit 53 generates a tone signal on the basis of the automatic play data stored in the data storage circuit 60; this data is supplied via the bus 30 upon read out of the data storage circuit 60 by the microcomputer 70. The tone signals generated from the rhythm tone signal generating circuit 51, keyboard tone signal generating circuit 52 and the automatic play tone signal generating circuit 53 are mixed together and the resultant signal is fed to an amplifier 54. An output of the amplifier 54 is in turn fed to a loudspeaker 55, which produces tones corresponding to the mixed tone signal.

The data storage circuit 60 includes a rhythm pattern data memory 61, a play data memory 62 and a buffer register 63, which are coupled to the bus 30. The rhythm pattern data memory 61 is constituted with a ROM in which rhythm pattern data for each of the rhythms has been stored in time sequence for the amount over the duration of one bar. The rhythm pattern data serves to instruct the rhythm tone signal generating circuit 51 to generate any one of the percussion tone signals. The play data memory 62 is constituted with a RAM which is divided into three storage regions (banks) each having equal sizes of memory (N) and having a number of storage locations APM(ADR) addressable by an address ADR to be described later. The following kinds of automatic play data are stored in the respective storage locations APM(ADR) in the data formats illustrated in FIG. 3, which are:

Timing data composed of an identification mark identifying timing data, and time data TIMD indicating the elapsed time after the leading portion of a bar;

Key depression data composed of an identification mark identifying the key depression event data in the keyboard 10, a key code KC indicative of the key depressed, and touch data KTD indicative of an initial key touch status (volume level);

Key release data composed of an identification mark identifying key release event data in the keyboard 10, and a key code KC indicative of the key released;

Timbre/effect data composed of an identification mark identifying either timbre data or effect data updated by the timbre buttons 27*a* or the effect buttons 27*b*, respectively, and timbre/effect name data indicating the name of the updated time or effect;

Bar (or measure) code indicative of a time of automatic playing which is in coincidence with a timing at the leading portion of a bar or measure; and End code indicative of an end timing of automatic play.

The microcomputer 70 is made up of a program memory 71, a central processing unit (CPU) 72 and a working memory 73, all of which are coupled to the bus 30. The program memory 71 is constituted with a ROM in which are stored a main program, a rhythm interruption program, and their subprograms. The CPU 72 starts implementation of the main program when a power source switch (not shown) is turned on and repeatedly implements the main program until the power source switch is turned off. The CPU 72 interrupts the implementation of the main program when the tempo clock signal is received from the tempo oscillator 40 and executes the rhythm interruption program. The working memory 73 is constituted with a RAM in which plural kinds of data and flags required for implementation of the main program are temporarily stored. Data and flags stored therein are primarily as follows;

Rhythm run flag RUN is indicative of the operational status of the auto-rhythm, in which "1" indicates the auto-rhythm is in operation; and "0" indicates the auto-rhythm is stopped;

Write auto-play flag APW indicates the operational status of automatic play, in which "1" indicates that automatic play data is being written into the play data memory 62 (i.e., recording mode), and "0" indicates that the status is not in the recording mode;

Read auto-play flag APR indicate the operational status of automatic play, in which "1" indicates that automatic play data is being read out of the play data memory 62 (i.e., play mode), "0" indicates that the status is not in the play mode;

Synchronization start flag SST for synchronizing the key manipulations by a performer with the rhythm tone at the time of writing the play data;

Head flag HEAD for searching a head portion of the automatic play in conformity with the bank designation by the performer;

Tempo counter TCNT which value is incremented by one whenever the tempo oscillator 40 generates a tempo clock signal, indicating an advanced position of the auto-rhythm within one bar;

Address ADR is an address of the play data memory 62;

Read data RDDT is the automatic play data read out of the play data memory 62;

Read timing data RDTIM indicates only the timing data contained in the automatic play data read out of the play data memory 62; and Bank data BANK indicative of a bank number of the memory 62.

The operations of the apparatus will be described as follows with reference to the flowcharts illustrated in FIGS. 4 through 11.

(1) Normal Play Mode

In a normal play mode, a musical tone is generated in accordance with the depression/release of the key in the keyboard 10 and manipulations of the operation panel 10.

When the power source switch (not shown) is turned on, the CPU 72 starts implementation of the main program in step 100. In step 101, the respective registers in the working memory 73 are cleared to thereby set the microcomputer 70 to an initial status. After the initial setting, in step 102, the CPU 72 scans the key switches contained in the key switch circuit 10*a* and the button switches contained in the button switch circuit 20*a* to thereby read depression/release data concerning the keyboard 10 and the operation data of the respective buttons on the operation panel 20 through the bus 30. In step 103, on the basis of the depression/release data and the operation data thus read, the CPU detects presence or absence of the depression/release event in the keyboard 10 and the operation event in the operation panel 20 in cooperation with the working memory 73. Assuming that none of the keys on the keyboard 10 are depressed or released and none of the buttons on the operation panel 20 are manipulated, the decision made in step 103 by the CPU 72 results in "NO", i.e., a decision is made so that the event is absent, whereupon the procedure returns to step 102 and the processing in steps 102 and 103 are cyclically executed.

When any one of the keys on the keyboard 10 is depressed or released, or when any one of the buttons on the operation panel 20 is manipulated, the decision made in step 103 by the CPU 72 results in YES, i.e., a decision is made so that the event is present, whereupon the program advances to step 104 in which kind of event is discriminated. In the normal play mode, the automatic play writing button 24*a*, the automatic play reading button 24*b* and the bank switches 25*a* through 25*c*, are all arranged on the operation panel 20 and are normally not manipulated. Therefore, description will be made with respect to the case where the keys or buttons excluding those mentioned above are depressed. Those which may be depressed are the keys on the keyboard 10, rhythm start button 21*a*, rhythm stop button 21*a*, rhythm selection buttons 22, up button 23*a*, down button 23*b*, timbre buttons 27*a* and effect buttons 27.

Figure 5:
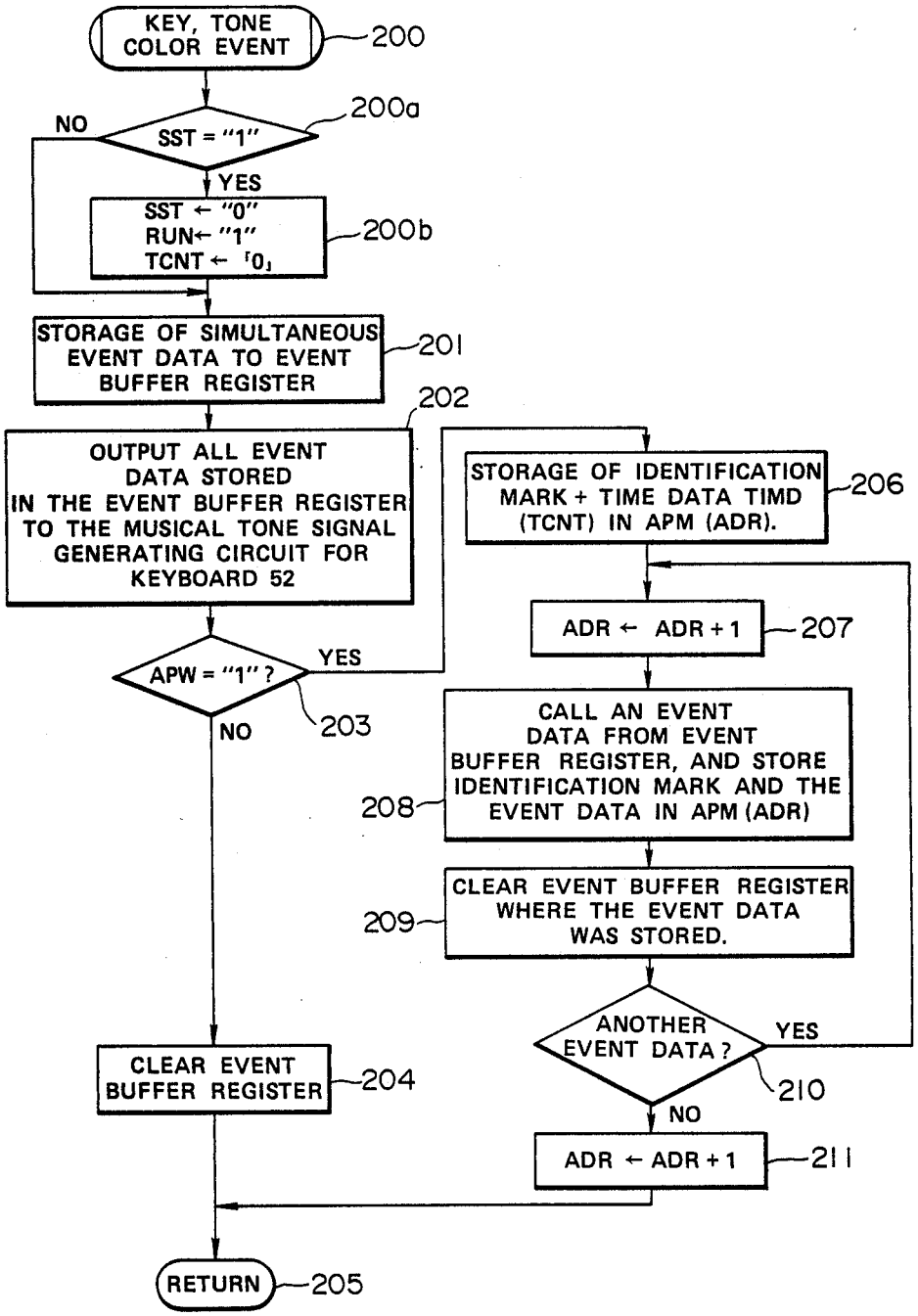

Firstly, description will be made with respect to the case when either of the keys on the keyboard 10, timbre buttons 27*a* and effect buttons 27*b* is depressed. In this case, upon processing the step 104, the program is advanced to step 105 and a key/timbre event routine, as illustrated in detail in FIG. 5, is executed. This routine begins with step 200, and in step 200*a* the CPU 72 checks whether or not the synchronization start flag ST is "1". Since the result of this check is "NO", the routine advances to step 201 where all the event data concerning the depressed keys and buttons are written into an event buffer register provided in the working memory 73. When any one of the keys on the keyboard 10 is depressed, the key touch data indicative of the initial key touch status detected by the key touch detecting circuit 10*b* when the key is depressed is also written into the event buffer register as part of the event data. In step 202, all such event data are outputted to the keyboard musical tone signal generating circuit 52 via the bus 30. The keyboard musical tone signal generating circuit 52 receives and stores the event data therein, and concurrently controls the generation of the tone signal on the basis of the event data. If the event data represents a key depression on the keyboard 10, the keyboard musical tone signal generating circuit 52 start generation of a high frequency musical tone signal corresponding to the key depressed. The resultant signal is supplied through the amplifier 54 to the loudspeaker 55. The initial key touch data is accompanied by the tone signal and is thus outputted to the musical tone signal generating circuit 52. The initial key touch data is utilized for controlling the volume of the tone signal generated from the circuit 52. As a result, the musical tone corresponding to the depressed key on the keyboard 10 is generated with a volume corresponding to the initial key-touch status. If the event data represents a key release on the keyboard 10, the keyboard musical tone signal generating circuit 52 stops generation of the tone signal of the released key. As a result, the tone signal concerning the released key is no longer generated from the loudspeaker 55.

In the event data supplied to the keyboard musical tone signal generating circuit 52 is the one which comes from the timbre buttons 27*a* or effect buttons 27*b*, the circuit 52 controls either the timbre of the tone signal or the effect imposed on the tone signal, depending upon the button manipulated. Thus, the timbre and the effect of the tone is controlled in accordance with the manipulation of the timbre buttons 27*a* and effect buttons 27*b*.

After the processing step 202, the CPU 72 checks in step 203 whether or not the auto-play write flag APW is "1". Since the fact that the electronic musical instrument is set to the normal play mode, the flag APW is "0", so the decision made at step 203 results in "NO". Then, the program advances to step 204. In step 204, the CPU 72 clears all the event data stored in the event buffer register and execution of the key/timbre event routine is terminated in step 205, whereupon the program returns to step 102 shown in FIG. 4. The CPU 72 again cyclically executes steps 102 and 103, and when a key on the keyboard 10 is depressed or released, or any one of the timbre buttons 27 is manipulated during this cyclic processing, the generation of the tone is controlled depending upon the depression or release of the key or the manipulation of the button as described above.

Next, description will be made with respect to the case when any one of the rhythm buttons 22, up button 23*a* and down button 23*b* is manipulated. During the cyclic processing in step 102 and 103, the CPU 72 advances the program to step 104 upon making "YES" decision in step 103. Through the processing in step 104, the processing in step 106 is carried out. In the processing in step 106, if the button manipulated is one of the rhythm selection buttons, the rhythm data stored in the working memory 73, representing the auto-rhythm is updated, depending upon the key manipulated. When either the up button 23*a* or the down button 23*b* is manipulated, the tempo data also stored in the working memory 73 representing the tempo of the auto-rhythm, is updated depending upon a period of time during which the button 23*a* or 23*b* is being operated. The updated data is supplied via the bus 30 to the tempo oscillator 40. In response thereto, the frequency of the tempo clock signal produced from the oscillator 40 is varied. In this manner, with the processing in step 106, the kind of rhythm and the rhythm tempo are determined in accordance with which buttons are manipulated among the rhythm selection buttons 22, the up button 23*a* and the down button 23*b*. After the processing in step 106, the CPU 72 again returns the program to step 102 and carries out the cyclic processing in steps 102 and 103.

During this cyclic processing, when the rhythm start button 21*a* is manipulated, "YES" decision is made by the CPU 72 in step 103 so that the program is advanced to step 104. Through the processing in step 104, the processing in step 107 is carried out. In the processing in step 107, the rhythm run flag RUN is set to "1" and the tempo counter TCNT is set to an initial value "0". After the processing in step 107, the CPU 72 returns the program to step 102 and again executes the cyclic processing in steps 102 and 103.

Figure 4:
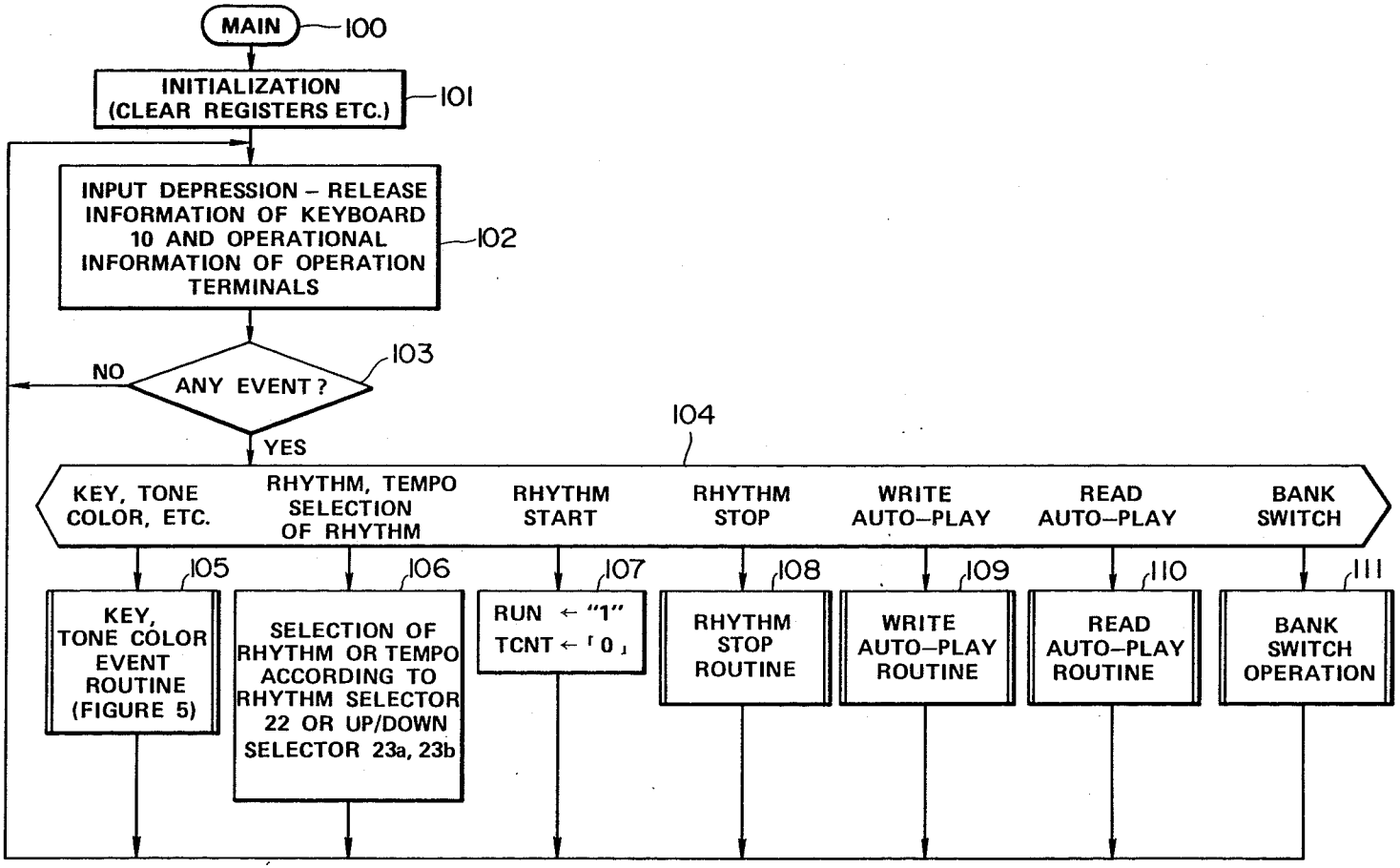
Figure 6:
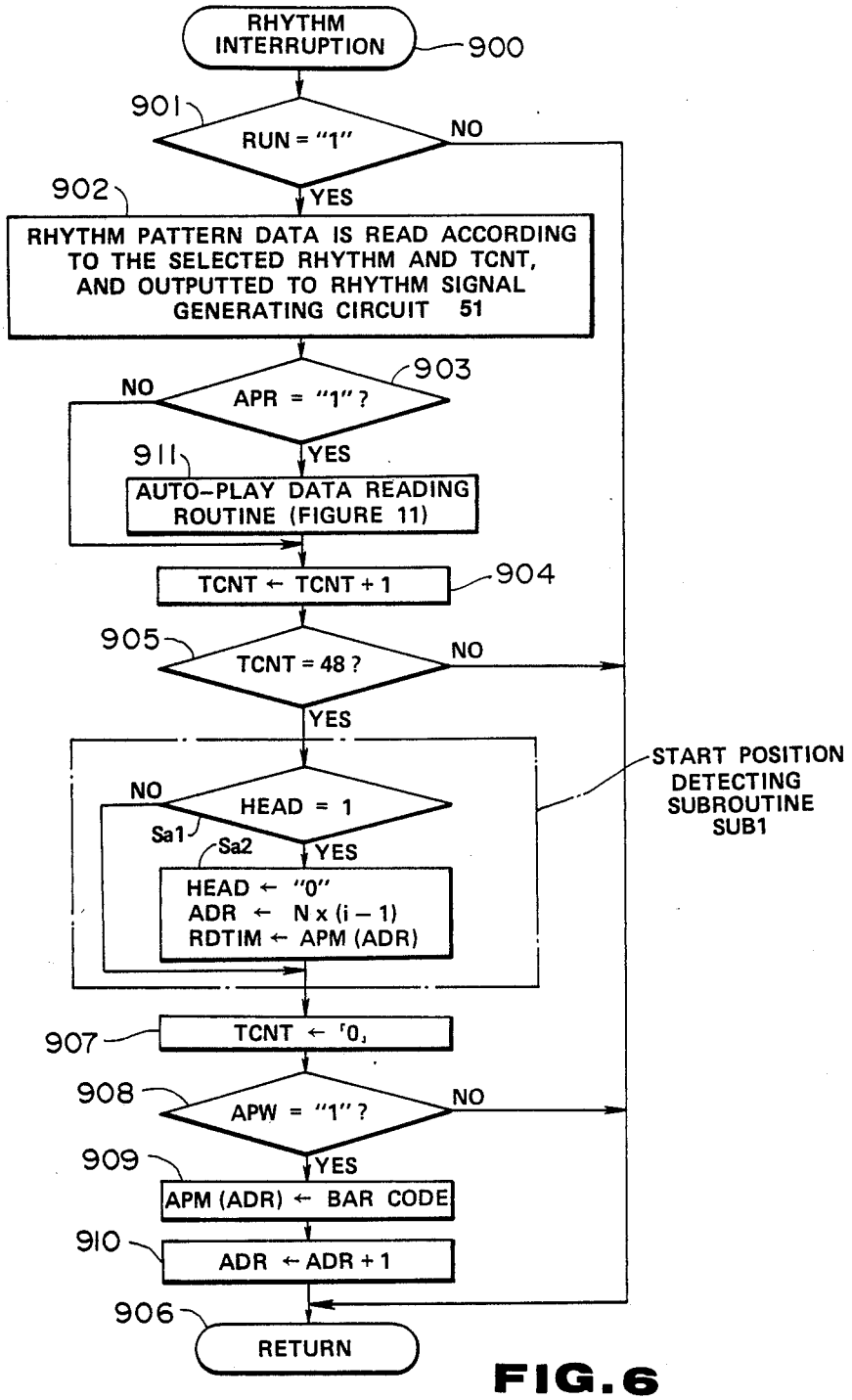

During this cyclic processing, when the tempo clock signal is generated from the tempo oscillator 40, the CPU 72 interrupts the execution of the program and starts implementation of the rhythm interrupt program illustrated in FIG. 6. The rhythm interruption program starts from step 900 and in step 901 the CPU 72 checks whether or not the rhythm run flag RUN is "1". Since the rhythm run flag RUN has been set to "1" in the processing in step 107 (FIG. 4), the decision made in step 901 results in "YES". Then, the program is advanced to step 902. In step 902, while referring to the rhythm pattern memory 61, the CPU 72 reads the rhythm pattern data out of the memory 61, which data has been set depending upon the rhythm kind data set by the manipulation of the rhythm selection buttons 22 and the tempo counter TCNT set to "0" through the processing in step 107 (FIG. 4). The CPU 72 outputs the data thus read out to the rhythm tone signal generating circuit 51 via the bus 30. In accordance with the rhythm pattern data, the rhythm tone signal generating circuit 51 generates a percussion tone signal and supplies the latter to the loudspeaker 55 through the amplifier 54. As a result, percussion tone corresponding to the rhythm pattern data is generated from the loudspeaker 55.

After the processing in step 902, the CPU 72 checks in step 903 whether or not the auto-play read flag APR is "1". In this check, since the electronic musical instrument is set to the normal play mode, the auto-play read flag APR is set to "0", the decision made in step 903 results in "NO" and the program is advanced to step 904. In step 904, the CPU 72 executes an operation of "TCNT=TCNT+1" so as to increment the tempo counter TCNT by one. That is, the tempo counter TCNT is set to "1". In step 905, the CPU 72 checks whether or not the thus incremented tempo counter TCNT represents an end value "48" of one bar. It is to be noted that in this embodiment, one bar is divided into 48 timings. Since the tempo counter TCNT does not represent the bar end value "48" at the time immediately after the tempo counter has been changed from "0" to "1", the decision made at step 905 results in "NO" and the program advances to step 906 at which the implementation of the rhythm interruption program is terminated. Before manipulation of the rhythm start button 21*a* and under the condition that the rhythm run flag RUN has been set to "0", the rhythm interruption program is implemented if the tempo clock signal is generated from the tempo oscillator 40. However, in this case, no percussion tone is generated because the decision made in step 901 results in "NO" due to the fact that the rhythm run flag RUN has been set to "0" and thus the program advances to step 906 without passing via step 902.

After completion of the rhythm interruption program, the CPU 72 carries out the program which was interrupted. Whenever the tempo clock signal is generated from the tempo oscillator 40, the above-mentioned steps from 900 through 906 of the rhythm interruption program are executed to thereby control the automatic tone generation from the percussion instrument in accordance with the rhythm pattern data, whereat the tempo counter TCNT is sequentially incremented one by one. During such operations, when a period of time corresponding to one bar has elapsed from the manipulation of the rhythm start button 21*a*, the reading of one bar rhythm pattern data out of the rhythm pattern data memory 61 is terminated, and simultaneously the tempo counter TCNT indicates a value "48" which coincides with the bar end. At this time, the CPU 72 makes "YES" decision in the processing in step 905 on the basis of the tempo counter TCNT and advances to step Sa1 of a head search sub-routine SUB. In step Sa1, the CPU 72 checks whether or not the head flag is "1". The result of the checking is "NO" in this case, therefore, the program jumps to step 907 out of the subroutine SUB 1. In step 907, the tempo counterer TCNT is set to the initial value "0" and the program advances to step 908. In step 908, the CPU 72 checks whether or not the autoplay write flag APW is "1". The electronic musical instrument is in the normal play mode in this case, so that "NO" decision is made by the CPU 72, with which the implementation of the rhythm interruption program is terminated. The auto rhythm play is again carried out from the beginning of the bar. The performer can play the keyboard while being accompanied by the auto rhythm.

Figure 7:
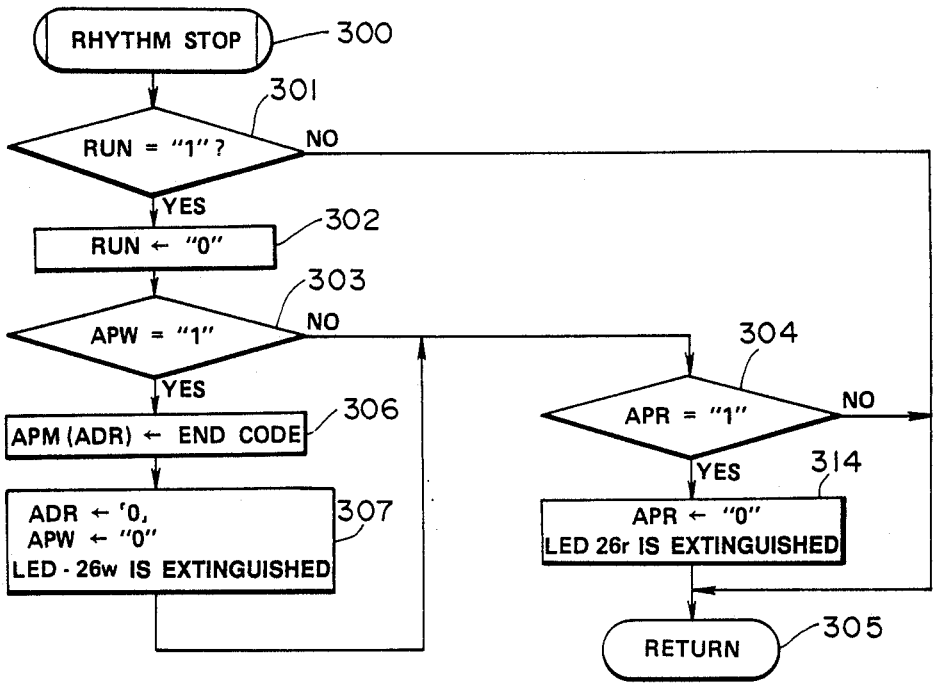

During such auto rhythm play, when the rhythm stop button 21*b* is manipulated, the CPU 72 makes "YES" decision during the cyclic processing through the steps 102 and 103 (FIG. 4). The program is then advanced to step 108 through the processing in step 104. In step 108, a rhythm stop routine as illustrated in detail in FIG. 7 is implemented. The rhythm stop routine starts with step 300, and in step 302 "YES" decision is made, since the rhythm write flag RUN has been set to "1" as mentioned above. In step 302, the flag RUN is set to "0", whereby the subsequent output of the tempo clock signal from the tempo oscillator 40 and the implementation of the rhythm interruption program (FIG. 6) do not cause the generation of a percussion tone. The auto rhythm play is thus stopped. After the processing of step 302, the CPU 72 checks in steps 303 and 304 whether or not the auto-play write flag APW and the auto-play read flag APR are "1". The electronic musical instrument is then in the normal play mode and thus both flags APW and APR have been set to "0", so the decision made in steps 303 and 304 result in "NO" in both instances. The implementation of this rhythm stop routine is thus terminated in step 305. In the case where the rhythm stop button 21*b* is manipulated when the auto rhythm is being stopped, i.e. in the condition when the rhythm run flag RUN is "0", the implementation of the rhythm stop routine starts with step 300. However, decision made in step 301 results in "NO" and thus the implementation of this routine is terminated with step 305. Accordingly, the manipulation of the rhythm stop button 21*b* does not exert any influence whatsoever on the operation of the electronic musical instrument.

(2) Automatic Play Recording Mode

In an automatic play recording mode, play data produced in accordance with depression/release of the keys on the keyboard 10 and manipulation of the operation panel 21 are written into a play data memory 62 as automatic play data.

When recording the play data, the performer first selects a bank (storage location) by means of bank switches 25*a* through 25*c*. He then depresses the write auto-play button 24*a* and then plays using the keyboard 10 and the various buttons on the operation panel 20.

Figure 10:
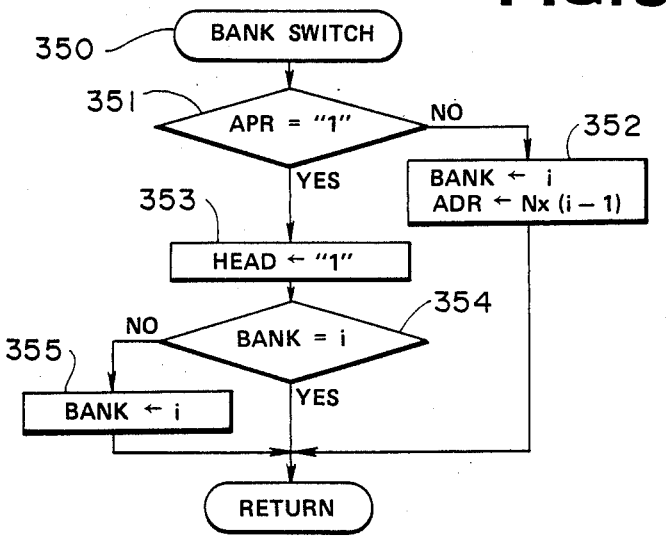

When either one of the bank switches 25*a* through 25*c* is used, the decision made in step 103 (FIG. 4) results in "YES", and the program advances to step 111 through the processing in step 104, in which the bank switch processing are carried out. FIG. 10 illustrates the bank switch processing, which start with step 350. In step 351, the CPU 72 checks whether or not the auto-play read flag APR is "1". The decision made in this step results in "NO" and the program advances to step 352. In step 352, the bank data BANK is set to i (i being a number assigned to a bank switch) and the address ADR is set to "N×(i−1)". Specifically, when the performer depresses the bank switch 25*a*, "0" is set as the address ADR. When the bank switch 25*b* is depressed, "N" is set as the address ADR, and when the bank switch 25*c* is depressed, "2N" is set as the address ADR. As mentioned previously, "N" is the quantity of each bank of the play data memory 6. As is apparent from the above, "0", "N", "2N" indicate start addresses of the respective banks. When the processing of step 353 is terminated, the program returns to step 102 shown in FIG. 4.

Next, with the manipulation of the automatic play write button 24*a*, the decision made in step 103 results in "YES" and the program advances through step 104 to step 109 of the auto-play write routine.

Figure 8:
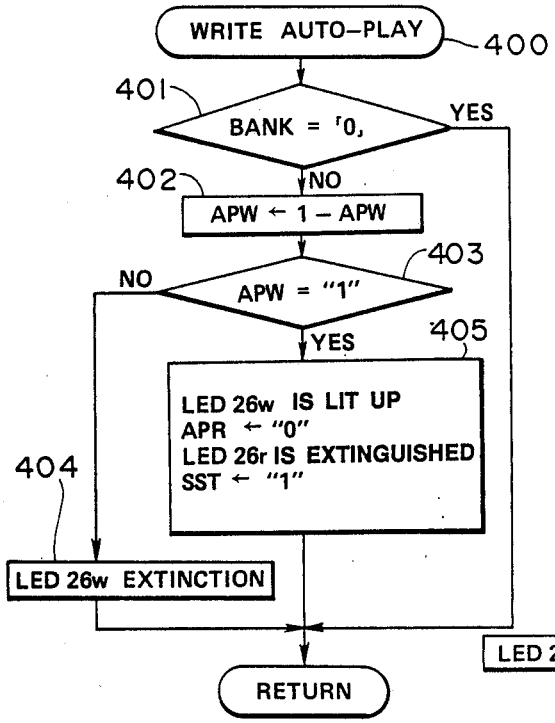

FIG. 8 is a flowchart illustrating the auto-play write routine. The routine starts with step 400 and in step 401, the CPU 72 checks whether or not the bank data BANK is "0". In the above-mentioned step 352 (FIG. 10), since the bank data BANK has been set to either one of "1" through "3", the decision made in this step results in "N0". Thus, the program advances to step 402. When the decision made in step 401 results in "YES", the program returns to step 102 (FIG. 4). In step 402, the auto-play write flag APW is subtracted from the data "1" and the resultant data is set to the flag APW. Specifically, the position of the auto-play write flag APW is reversed. In the next step 403, the CPU 72 checks whether or not the auto-play write flag APW is "1". When the result of this checking is "NO", the program advances to step 404 where the LED 26*w* (FIG. 2) is turned off. In contrast, when the result of checking in step 404 is "YES", the program advances to step 405. In step 405, the LED 26*w* is lit, the auto-play read flag APR is reset, the LED 26*r* is turned off, and the synchronization start flag SST is set to "1". whereupon the program returns to step 102.

In this manner, when the auto-play write button 24*a* is manipulated, the auto-play write flag APW is reset provided that the latter flag is "1" (write enable status), and the LED 26*w* is turned off when the write enable status is terminated. Conversely, in the case where the flag APW is "0", each of the settings in step 405 is carried out to thereby place the apparatus in the write enable status.

Under the status that the flag APW is "1", when the performer plays using the keyboard 10 and the various buttons on the operation panel 20, the play data indicating the play condition is sequentially written into the bank of the play data memory 62 specified by one of the bank switches 25*a* through 25*c*. More specifically, when the performer depresses a key on the keyboard 10, the program advances to key/timbre event routine (FIG. 5) through steps 103 and 104. In this routine, the CPU 72 checks in step 200*a* whether or not the synchronization start flag SST is "1". Since the decision made in this step results in "YES" (see step 405 in FIG. 8), the program advances to step 200*b*. In step 200*b*, the synchronization start flag SST is reset, the rhythm run flag RUN is set, and the tempo counter TCNT is cleared or reset. After the processing in steps 201 and 202 are executed, the program advances to step 203. Since the decision made in step 203 results in "YES", the program advances to the play data write routine composed of steps 206 through 211.

In step 206 of this routine, timing data is written as play data into the storage location APM(ADR) of the play data memory 62. This timing data is, as shown in FIG. 3, made up of the identification mark and the time data TIMD. The identification mark is set to a code indicating that the play data is the timing data and the time data TIMD is set to a value indicated by the tempo counter TCNT. As such, the time data TIMD indicates a period of time elapsing from a bar line. At this time, "0" is the data written as the timing data into the storage location APM(ADR) of the memory 62. After execution of the address increment processing (ADR=ADR+1) in step 207, the CPU 72 fetches one of the event data which has been stored in the event buffer register in the processing of step 201, and stores the fetched data in a storage location ARM(ADR) of the play data memory 62 as a play data. Specifically, if the event data thus fetched concerns the one resulting from the depression of the key on the keyboard 10, stored therein as the play data are the identification mark identifying the depression of the key, the key code KC indicative of the key depressed, and the key touch data KTD indicative of the initial key touch, all as shown in FIG. 3. If the even data thus fetched concerns the one resulting from the release of the key on the keyboard 10, stored therein as the play data are the key release data which include the identification mark identifying the release of the key and the key code KC indicative of the key released, as also shown in FIG. 3. Furthermore, if the event data thus fetched concerns the one resulting from the manipulation of one of the timbre buttons or effect buttons 27*b*, stored therein as the play data are the timbre or effect data which includes the identification mark identifying timbre/effect data and the timbre/effect name data indicative of the name of the timbre/effect. At this time, the key depression data shown in FIG. 3 is stored as the play data.

After step 208, the CPU 72 clears, the event data in the event buffer register, (which has been transferred and stored in the play data memory 62) in step 209. In step 210, the CPU 72 checks whether or not the event data remains in the register. If affirmative, the result of the checking in step 210 is "YES", and the CPU 72 again executes the processing in steps 207 through 209 and stores the play data in the subsequent storage location APM(ADR+1) of the play data memory 62 in the manner as described above. As a result of the processing in steps 207 through 209, if the residual event data has become empty, the CPU 72 makes "NO" decision in step 210 and increments the address ADR by "1" in step 211. The implementation of the key/timbre event routine is terminated with the processing in step 205. As a result, if there are depressions or releases of the keys on the keyboard 10 or the manipulations of the timbre buttons 27*a* and the effect buttons 27*b*, the simultaneously depressed keys or the depressed key data or the timbre data or the like are stored after the timing data. By the processing of steps 206 through 210 in the key/timbre event routine and the processing of steps 908 and 909 in a rhythm interruption program (FIG. 6, described below), the bar code for a bar is incorporated into the play data stored in the play data memory 62 at every internal of the bars. In addition, the play data concerning the keyboard 10, timbre buttons 27*a* or the effect buttons 27*b* for the simultaneous events are stored together with the timing data in the lead position.

On the other hand, once the rhythm run flag RUN is rendered "1" due to the processing in step 200*b*, whenever a tempo clock signal is generated, the processing in steps 900 through 906 of the rhythm interruption program (FIG. 6) are executed and the auto rhythm play is performed in accordance with the tone generation control of the percussion tone performed in step 902. In this case, when the auto rhythm play reaches the bar line, the CPU 72 makes a "YES" decision in step 905 as described, and then the program advances to step 907 through step Sa1. After setting the tempo counter TCNT to the initial value in step 907, the CPU 72 makes a "YES" decision in step 908 in accordance with the auto-play write flag APW which has been set to "1" in step 908. In step 909, the bar code (see FIG. 3) is written into the storage location APM(ADR) of the play data memory 62. In step 910, by the operation of "ADR=ADR+1" in step 910, the address ADR is incremented by "1", and the implementation of the rhythm interruption program is terminated. Thus, together with the auto rhythm play, a line of code for a bar is written into the play data memory 62 each time there occurs a new bar line as the music progresses.

When the rhythm stop button 21*b* is manipulated to terminate the automatic play recording mode, the CPU 72 makes a "YES" decision in step 103 during the execution of the cyclic processing of steps 102 and 103. The program advances to step 108 through the check processing in step 104. In step 108, a rhythm stop routine is implemented, as illustrated in detail in FIG. 7. As in the previous description, the rhythm-stop routine begins with step 300. In the processing in steps 301 and 302, the rhythm run flag RUN is set to "0" to thereby effect a stop control for the auto rhythm play. However, the auto-play write flag APW has been set to "1" so that a "YES" decision is made by the CPU 72 in the subsequent step 303. The program advances to step 306 in which the end code is written into the storage location APM(ADR) of the memory 62. In step 307, the address ADR is set to "0", the auto-play write flag APW is reset, and the LED 26*w* is turned off, and the write mode is terminated. In step 304, the CPU 72 checks whether or not the auto-play read flag APR is "1". Since the decision made in step is "NO", the program returns to step 102 via step 305.

(3) Auto Play Mode

In an auto-play mode, upon reading play data out of the play data memory 62, auto-play is performed in accordance with the play data thus read out.

Figure 12:
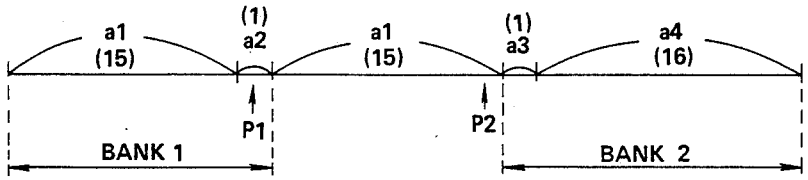
FIG. 12 is an explanatory diagram for description of an automatic play mode.

If, for example, a piece of music for auto-play play is composed as shown in FIG. 12:

a1 (15 bars)+a2 (1 bar)+a1+a3 (1 bar)+a4 (16 bars)

In such an instance, (a1+a2) and (a3+a4) are stored in advance, for example, in banks 1 and 2 of the play data memory 62, respectively. To perform the auto-play, the bank 1 is first designated by the bank switch 25*a*, and then the auto-play read button 24*b* is depressed, whereby the automatic play of (a1+a2) is performed. Next, the performer again depresses the bank switch 25*a* which designates the bank 1 while the automatic play is playing a portion a2 (see arrow P1), so that the automatic play of the a1 portion is carried out immediately after the automatic play of a2 has terminated. Next, the performer depresses the bank switch 25*b* when the automatic play is playing the last bar (see arrow P2), whereby the automatic play of the (a3+a4) portion stored in the bank 2 is carried out immediately after the automatic play of the a1 portion has terminated.

Steps of the above described automatic play will be described in more detail.

When the performer depresses the bank switch 25*a*, a decision made in step 103 (FIG. 4) results in "YES", and the program advances through step 104 to step 111 for a bank switch processing (FIG. 10). The bank switch processing start with step 350, and in step 351, the CPU 72 checks whether or not the auto-play read flag APR is "1". The program advances to step 352 where the bank data BANK is set to "i" and the address ADR is set to "0", whereupon the program returns to step 102.

Figure 9:
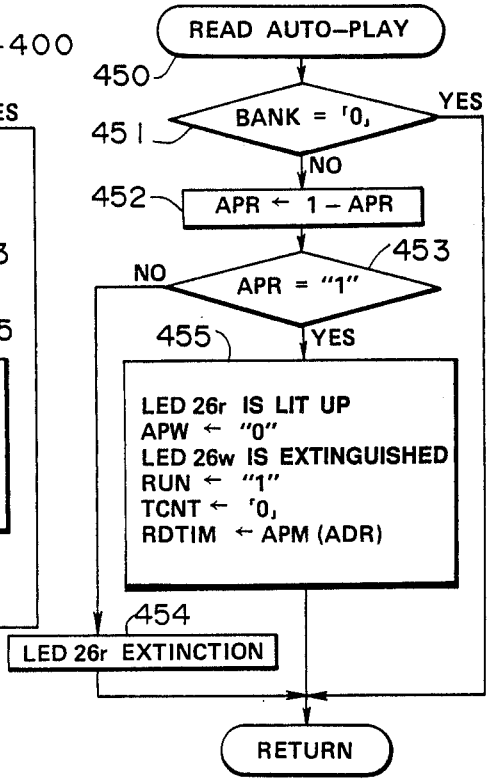

When the performer manipulates the automatic play read button 24*b*, the program advances through steps 103 and 104 to step 110 where an auto-play read routine is executed. FIG. 9 is a flowchart illustrating the auto-play read routine. The routine starts with step 450, and in step 451, the CPU 72 checks whether or not the bank data BANK is "0". The decision made in this step results in "NO", and the routine advances to step 452. In step 452, the auto-play read flag APR is reversed (see step 402 in FIG. 8). In step 453, the CPU 72 checks whether or not the auto-play read flag APR is "1". When the decision made in this step is "NO", the routine advances to step 454 where the LED 26*r* is turned off to terminate the auto-play mode. On the other hand, when the decision made in step 453 is "YES", the routine advances to step 455 where the following processing are carried out: The LET 26*r* is lit; the auto-play write flag APW is reset; the LED 26*w* is turned off; the rhythm run flag RUN is set; the tempo count PCNT is cleared; and, the data stored in the storage location APM specified by the address ADR (in this case, "0": see step 352) is read out and is set as the read timing data RDTIM. Then, the routine returns to step 102.

The above-described processing in step 455 is a preliminary processing for carrying out the automatic play. Upon processing of step 455, the automatic play is carried out in accordance with the tempo clock signal outputted from the tempo oscillator 40 in a manner described later.

Specifically, upon output of the tempo clock signal, the processing by the CPU 72 advances to the rhythm interrupt processing shown in FIG. 6 which begins with step 900. Since the decision made in step 901 results in "YES", the routine advances to step 902 where the rhythm tone is produced. In step 903, the CPU 72 checks whether or not the auto-play read flag APR is "1". The decision made in this step results in YES so that the routine advances to step 911 for automatic play data read routine.

Figure 11:
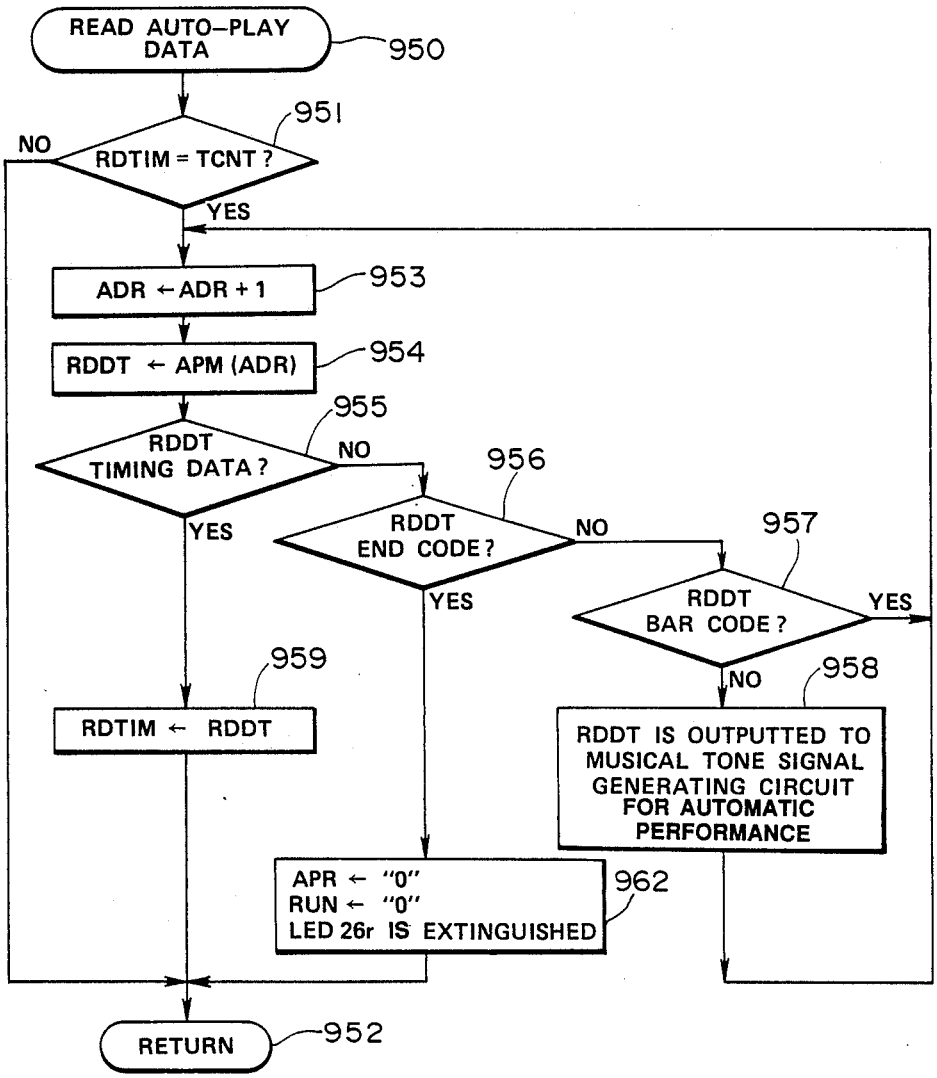

FIG. 11 is a flowchart illustrating the automatic play data read routine. This routine starts with step 950. In step 951, the CPU 72 checks whether or not the read timing data RDTIM which has been subjected to initial setting in step 405 (FIG. 9) or the read timing data RDTIM to be later set in step 959 (to be described later) is equal to the value in the tempo count TCNT. Provided that the read timing data RDTIM and the value in the tempo count TCNT are not equal to each other, the decision made in step 951 results in "NO". If it is the case, the implementation of the automatic play data read routine is terminated with step 952. On the other hand, due to the increment of the value in the tempo count TCNT, if the read timing data RDTIM and the value in the tempo count TCNT are equal to each other, the CPU 72 makes "YES" decision in step 951 and increments the address ADR by "1" in step 953. In step 954, the data is read out of the storage location APM(ADR) of the play data memory 62 by addressing with the address thus incremented in step 954, and the play data thus read out is set as the read data RDDT.

Next, through the processing in steps 955 through 957, the CPU 72 determines where the read data RDDT is among the timing data, end code, code for the bar or other kinds of data (key depression data, key release data, timbre data, etc.). If the read data RDDT is among the above-mentioned other kinds of data (key depression data, key release data, timbre data, etc.), all the decisions made in steps 955 through 957 result in "NO". In step 958, the read data RDDT is outputted to the automatic play musical tone signal generating circuit 53 via the bus 30. The automatic play musical tone signal generating circuit 53 controls production of the tone signal on the basis of the key depression data, key release data or timbre data, etc. supplied thereto. The tone signal thus produced is outputted to the loudspeaker 55 through the amplifier 54. The loudspeaker 55 produces tone or sound in accordance with the tone signal. That is, tone is automatically produced from the loudspeaker 55 in accordance with the play data stored in the play data memory 62.

After the processing in step 958, the CPU 72 returns the program to step 953 where the address ADR is incremented by "1". In step 954, the play data in the storage location APM(ADR) of the play data memory 62 designated by the address ADR thus incremented in step 954 is again set as the read data RDDT, and the kind of this read data RDDT is discriminated in steps 955 through 957. As in the previous description, if the read data RDDT is again either the key depression data, key release data or timbre data, the production of the tone is controlled through the processing in step 958. In this manner, all of the key depression data, key release data, timbre data, etc. which have been stored at the same timing are read out of the play data memory 62, whereupon the production of tone for the automatic play is controlled.

During the cyclic processing of steps 953 through 958, when the read data RDDT set in step 954 agrees with the timing data, the CPU 72 makes a "YES" decision in step 955, and set that read data RDDT as the read timing data RDTIM. The implementation of the automatic play data read routine is thus terminated with step 952. Thereafter, whenever the rhythm interrupt program is implemented, the processing of step 950 through 952 are executed. When the read timing data RDTIM as set is equal to the value of the tempo count TCNT, the CPU 72 executes the processing in steps 953 through 958 and controls the production of tone or sound of the automatic play tone.

In the case where the read data RDDT set in step 954 is the bar code, the decision made in step 957 results in "YES" and the program returns to step 953. In the case where the read data RDDT is the end code, the decision median step 956 results in "YES" and the program advances to step 962. In step 962, both the auto-play read flag APR and the rhythm run flag RUN are reset and the LED 26*r* is turned off, with which the automatic play in accordance with the play data stored in the play data memory 62 as well as the play of the auto rhythm is terminated.

The automatic play in accordance with the play data in the bank 1 proceeds and when the bank switch 25*a* is depressed at an instant in the cause of the automatic play in the a2 portion (FIG. 12), the decision made in step 103 (FIG. 4) results in "YES" and the program advances through step 104 to a bank switch processing (FIG. 10) in step 111. In this bank switch processing, the program advances from step 350 to step 351 where the CPU 72 checks whether or not the auto-play read flag APR is "1". The decision made in this step results in "YES", so that the program advances to step 353 where the head search flag HEAD is set to "1". In step 354, the CPU 72 checks whether or not the current bank data BANK agrees with the data "1" corresponding to the bank switch 25*a* as depressed at this time. Since the decision made in this step results in "YES", the program returns to step 102. When the decision made in step 354 is "NO", the program advances to step 355 where the data "1" through "3" corresponding respectively to the bank switch 25*a* through 25*c* which are depressed at this time are set as the bank data BANK.

In this fashion, when the bank switch 25*a* is depressed during the automatic play in the a2 portion, the head search flag HEAD is set to "1". The latter processing does not influence the automatic play of the a2 portion.

At the end of the a2 portion, i.e. at the bar line, the decision made in step 905 during the rhythm interrupt processing results in "YES", so that the program advances to step Sal of the head searching subroutine SUB1 where the CPU 72 checks whether or not the head search flag HEAD is "1". The decision made in this step results in "YES" (see step 353 in FIG. 10), so that the program advances to step Sa2. In step Sa2, the head search flag HEAD is reset, "N×(i−1)" (in this case "0") is set as the address ADR, and the data in the storage location of the play data memory 62 addressed by the address ADR (in this case, "0") is set as the read timing data RDTIM. In the above processing, the bank data BANK is used for i. Then, the program returns to the main routine through steps 907, 908 and 906.

As described, the head search flag HEAD is set to "1" dependent upon the depression of the bank switches 25*a* through 25*c*, then the processing in step Sa2 is executed in the subsequent bar line, whereupon the automatic play returns to the head portion corresponding to either of the bank switches 25*a* through 25*c* depressed.

Thereafter, the automatic play of the a1 portion is again performed. And, when the bank switch 25*b* is depressed in the course of the automatic play in the last bar in the a1 portion (see arrow P2 in FIG. 12), the processing in steps 351 and 353 shown in FIG. 10 are executed, whereupon the program advances to step 354. In step 354, the CPU 72 checks whether or not the bank data BANK is "1". Since the bank data BANK is "1" and the bank switch depressed is 25*b*, i.e. i=2, the decision made in step 354 results in "NO". Then, the program advances to step 355. In step 355, the bank data BANK is set to i (in this case, "2") and then the program returns to step 102. As a result of the above processing, when the automatic play has reached the next bar line, the processing in step Sa2 shown in FIG. 6 is executed as is described above, whereupon the automatic play proceeds to the head portion of the bank (in this case, bank 2) corresponding to one of the bank switches 25*a* through 25*c*. Thereafter, the automatic play is performed with respect to the portion (a3+a4) stored in the bank 2. The foregoing is the description regarding the first embodiment of the present invention.

Figure 13:
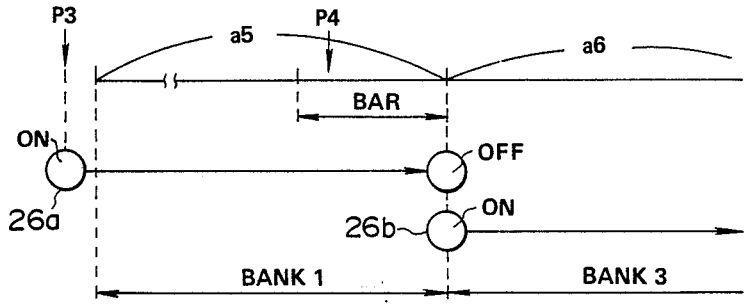
FIG. 13 is an explanatory diagram for description of lighting conditions of LEDs according to a second embodiment of this invention.

Next, a second embodiment of the present invention will be described. Although in the first embodiment, LEDs 26*a*, 26*b* and 26*c* are not lit, lighting controls with respect to those LEDs are carried out in the second embodiment. FIG. 13 is a diagram which exemplifies lighting states of LEDs 26*a* through 26*c*. In this example, a piece of music is composed of:

a5+a6+ . . .

where the portions a5 and a6 are stored in the banks 1 and 3, respectively. In this case, the performer first depresses the bank switch 25*a* (arrow P3) and at the last bar of the portion a5 depresses the bank switch 25*c* (arrow P4). At the time when the performer depresses the bank switch 25*a*, the LED 26*a* is lit. Subsequently, the play of the portion a5 is terminated. At the time when the play of the portion a6 starts, the LED 26*a* is turned off while the LED 26*c* is lit. Specifically, according to the second embodiment, the LED 26*a* is being lit when the automatic play based upon the play data in the bank 1 is being performed. Similarly, the LEDs 26*b* and 26*c* are lit when the automatic play based upon the play data in banks 2 and 3 are being performed.

The operations mentioned above will be described in more detail. The second embodiment differs from the first embodiment in the bank switch processing shown in FIG. 10, and in the head searching subroutine SUB 1 shown in FIG. 6. The processing and the subroutine according to the second embodiment are shown in FIGS. 14 and 15, respectively, in which the same processing, as executed in the first embodiment, are denoted by the same numerals.

Figure 14:
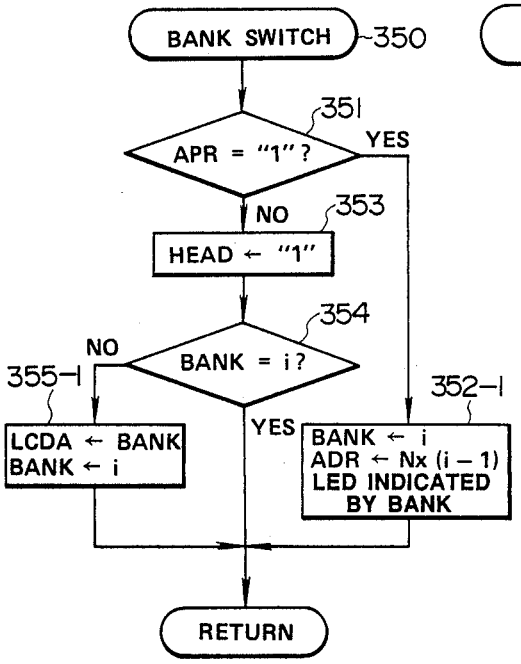
FIGS. 14 and 15 are flowcharts each showing processing executed by a CPU according to the second embodiment of this invention.

When the bank switch 25*a* is depressed (arrow P3), the procedure advances to step 352-1 through steps 350 and 351 in FIG. 14, where i (in this case, "1") is set to the bank data BANK and simultaneously "N×(i−1)" is set to the address ADR. Further, the LED specified by the value of the bank data BANK is lit (in this case, LED 26*a*). When the automatic play read button 24*b* is depressed, the auto-play read flag APR is set to "1". Thereafter, the automatic play is carried out. When the bank switch 25*c* is depressed in the last bar of the portion a5 (arrow P4), the program advances to step 353 via steps 350 and 351 in FIG. 14, where the head search flag HEAD is set to "1". Since the decision made in step 354 results in "NO", the program advances to step 355-1. In step 355-1, the bank data BANK is set as LED control data LCDA, and then the data i (in this case "3") is set as the bank data BANK, which data corresponds to the bank switch manipulated at this time, whereupon the program returns to step 102.

Figure 15:
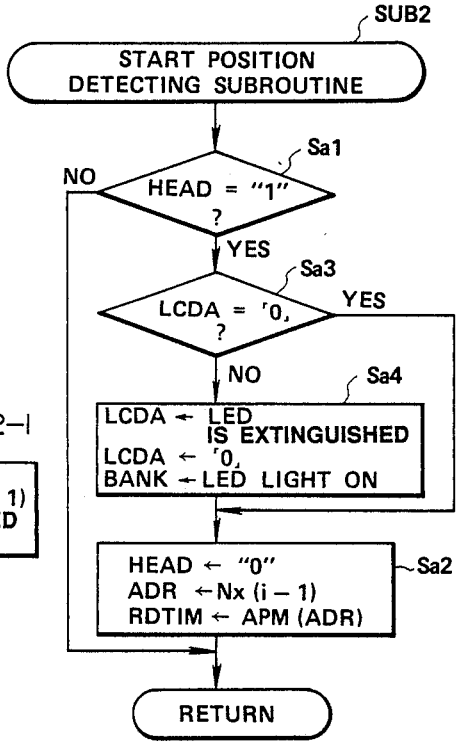

Next, at the bar timing at which the decision made in step 905 in FIG. 6 results in "YES", the program proceeds to the head searching subroutine SUB2 in FIG. 15. In this subroutine SUB 2, since the decision made in step Sa2 results in "YES", the routine advances to step Sa3. In step Sa3, the CPU 72 checks whether or not an LED control data LCDA is "0". In the case where the decision made in this step is "YES", i.e. when the same bank switch as that in the arrow P3 is depressed at the time indicated by arrow P4 in FIG. 13 (when the processing in step 355-1 in FIG. 14 is not executed), the routine advances to step Sa2. On the other hand, in the case where the decision made in step Sa3 is "NO", i.e., when a bank switch different from that depressed at the instant indicated by arrow P3 is depressed at the instant indicated by arrow P4, the routine advances to step Sa4. In step Sa4, the LED corresponding to the LED control data LCDA (in this case, 26*a*) is turned off. Subsequently, the LED control data LCDA is rendered "0" and the LED corresponding to the bank data BANK is lit (in this case, 26*c*). Next, the processing in step Sa2 is executed, whereupon the routine advances to step 907 in FIG. 6. The foregoing is the description with respect to the second embodiment.

Next, description will be made with respect to a third embodiment of the present invention. In this embodiment, red, yellow and green lights emitting LEDs are employed for the LEDs 26*a*, 26*b* and 26*c*, respectively. Those LEDs are subjected to lighting control as shown in FIG. 16 or 17.

Figure 16:
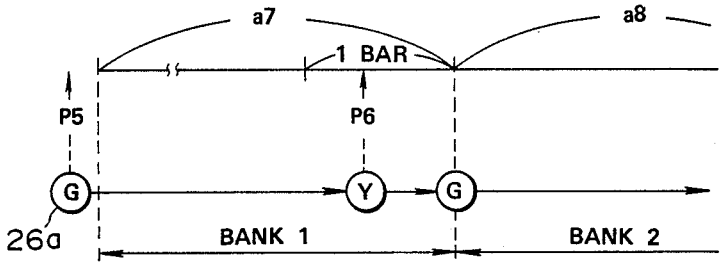
FIGS. 16 and 17 are explanatory diagrams for description of lighting state of LEDs according to a third embodiment of this invention.

Specifically, FIG. 16 is directed to the case where during the automatic play, the bank switch specifying the same bank as the one which is playing is depressed. Assuming that the bank switch 25*a* is depressed before commencement of the play (arrow P5), the LED 26*a* is turned on to emit green light. At the instance indicated by arrow P6, if the same bank switch 25*a* is depressed, the color of light emitted from the LED 26*a* is yellow and at the subsequent bar line, the color thereof again turns to green.

Figure 17:
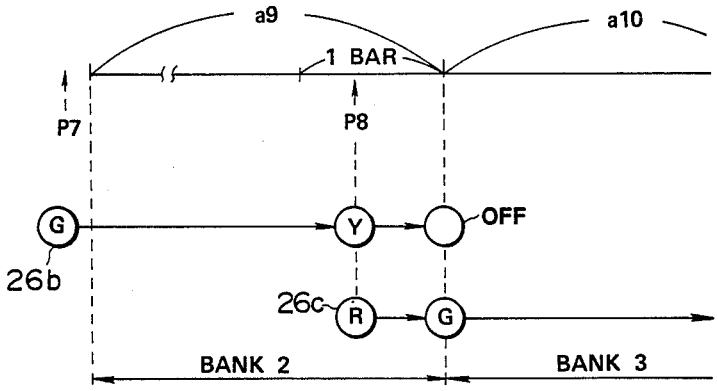

FIG. 17 applies directed to the case in which, during the automatic play, a bank switch specifying a different bank as the one which is playing is depressed. Assuming that the bank switch 25*b* is depressed before commencement of the play (arrow P7), the LED 26*b* is turned on to emit green light. At the instant indicated by arrow P8, if the bank switch 25*c* is depressed, the color of light emitted from the LED 26*b* turns to yellow at this instant and the LED 26*c* is turned on to emit yellow light. In the subsequent bar line, the LED 26*b* is turned off and the color of light emitted from the LED 26*c* turns to green.

In this manner, according to the third embodiment, the LED corresponding to the bank which is under playing emits green light, and during a period of time from the depression of the bank switch to the subsequent disappearance of light, the LED emits yellow light. In addition, from the depression of the bank switch to the commencement of the play, the LED emits red light.

As in the second embodiment, processing of the third embodiment differ from those of the first embodiment in the bank switch processing (FIG. 10) and the head searching subroutine SUB 1 (FIG. 6). The bank switch processing and the head searching subroutine SUB1 are illustrated in FIGS. 18 and 19, respectively.

Figure 18:
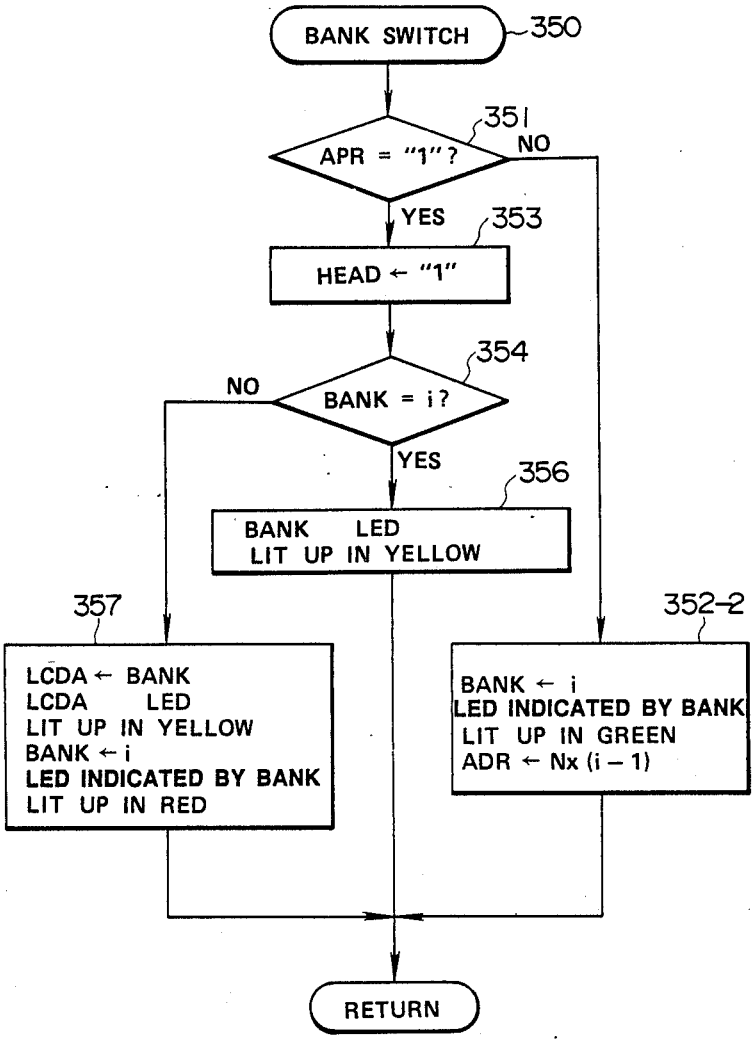
FIGS. 18 and 19 are flowcharts, each showing processing executed by a CPU according to the third embodiment of this invention.

When any one of the bank switches 25*a*, 25*b* and 26*b* is depressed by the performer before commencement of the automatic play, the program advances through steps 350 and 351 to step 352-2 in FIG. 18. In step 352-2, data i is set as the bank data and the LED corresponding to i is turned on to emit green light. Further, in step 352-2, "N×(i−1)" is set as an address. The program then returns to step 102. Next, the auto-play read flag APR is set to "1" so that the auto-play is commenced. Next, when the bank switches 25*a* through 25*c* are depressed, the program again advances to step 353 via steps 350 and 351, where the head search flag HEAD is set to "1". Then, the program advances to step 354 where the CPU 72 checks whether or not the bank data BANK is equal to the data i indicating the last depressed bank switch. If the decision made in this step is "YES" (in the case of FIG. 16), the program advances to step 356. In step 356, the LED indicated by the data i is turned on to emit yellow light. On the other hand, when the decision made in step 354 is "NO" (in the case of FIG. 17), the program advances to step 357. In step 357, the bank data up to the present is set as the LED control data LCDA, and the LED indicated by the LED control data LCDA is turned on to emit yellow light. Subsequently, data i is set to the bank data BANK, and the LED indicated by the bank data BANK is turned on to emit red light. Then, the program returns to step 102.

Figure 19:
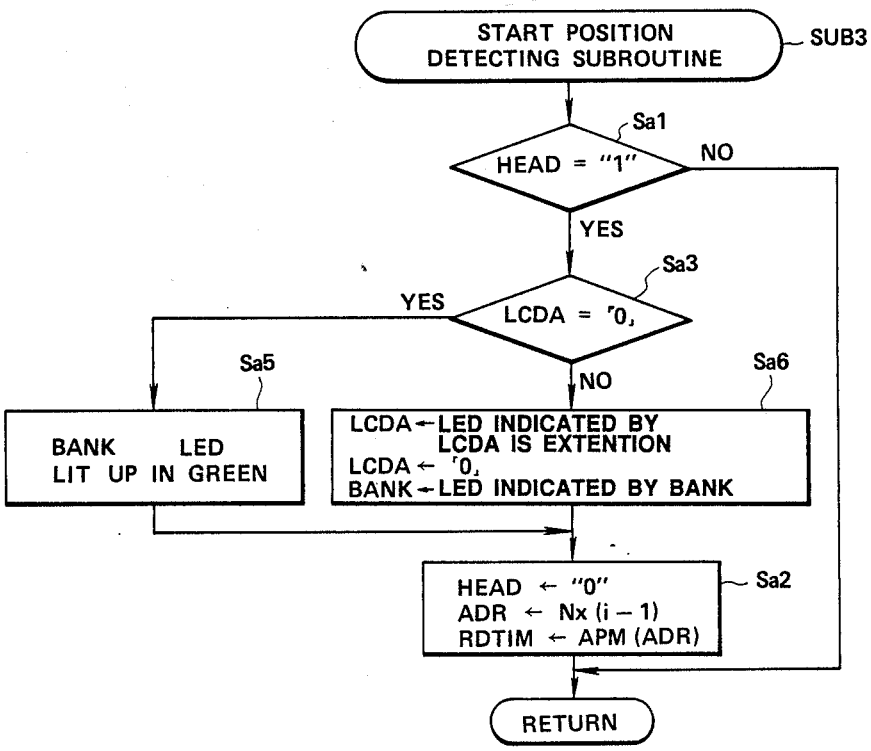

At the timing of the bar line, the decision made in step 905 in FIG. 6 results in "YES", the program proceeds to the head searching subroutine SUB 3 shown in FIG. 19. In this subroutine SUB 3, the routine advances to step Sa3 via step Sa1, where it is checked whether or not the LED control data LCDA is "0". When the decision made in this step is "YES" (in the case of FIG. 16), the routine advances to step Sa5 where the LED indicated by the bank data BANK is turned on to emit green light. When the decision made in step Sa5 "NO" (in the case of FIG. 17), the routine advances to step Sa6. In step Sa6, the LED indicated by the LED control data LCDA is turned off. Subsequently, that data LCDA is rendered "0", and then the LED indicated by the bank data BANK is turned on to emit green light. After processing of step Sa2, the routine advances to step 907 in FIG. 6.

Figure 20:
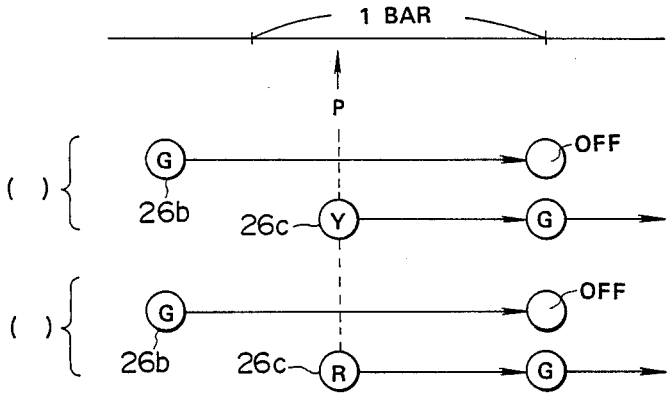
FIG. 20 is an explanatory diagram for the description of a modification of the third embodiment.

In the third embodiment, the lighting states of the LEDs 26*a* through 26*c* as indicated in FIG. 17 may be modified to those as shown in FIG. 20.

In the description of the foregoing embodiment, although a piece of music is separated into several segments on a unitary bar basis, it may be separated thereinto by a predetermined number of bars as a unit.

Further, in the foregoing embodiments, although a distinction of a piece of music is detected from the count value of the tempo count TCNT, the distinction thereof may by detected from the fact that the bar code is read out of the play data memory (see step 957 in FIG. 11).

Furthermore, although in the foregoing embodiments, the play data memory is separated into a plurality of segments (three) and writing of and reading from the play data are carried out while specifying a desired bank, the present invention is not limited thereto but is applicable to the case of a single bank without separating the play data memory into a plurality of banks. In such a case, the reading address of the play data memory may be changed to a predetermined address which has previously been set (for example, to the first address) at first distinction of the music following the depression of a repetition switch separately provided in lieu of the bank switch. To this effect, the step 353 in FIG. 10 may be executed with an on event of the repetition switch.

As described, according to the present invention, the play data not entirely stored in the memory can be repeatedly played with approximately timed switch manipulations. Therefore, with respect to a piece of music containing repetitive phrases, the quantity of play data in storage can be reduced.

What is claimed is:

1. An automatic music playing apparatus for automatically playing music, the music being composed of consecutive segments having a rhythm, the apparatus comprising:

(a) memory means for storing musical data corresponding to the rhythmic segments;
(b) detecting means for detecting a forthcoming segment;
(c) control means for reading the musical data of the rhythmic segments in a predetermined order and for starting reading data of a preselected rhythmic segment different from the detected segment after completion of reading the rhythmic segment being read, according to an instruction therefor; and
(d) musical tone generating means for generating a musical tone according to the musical data read by the control means.

2. An automatic music playing apparatus according to claim 1 wherein the control means comprises specifying means for specifying data of the preselected rhythmic segment according to the instruction.

3. An automatic music playing apparatus according to claim 2 wherein the specifying means includes an addressing means for addressing the control means to a predetermined data of the preselected rhythmic segment.

4. An automatic music playing apparatus according to claim 3 wherein the specifying means includes an addressing means for addressing the control means to a first data of the preselected rhythmic segment.

5. An automatic music playing apparatus according to claim 1 wherein the instruction to start reading data of a preselected rhythmic segment consecutive to the rhythmic segment being read is put in manually during the play of the music.

6. An automatic music playing apparatus according to claim 1 wherein the music is composed of original rhythmic segments and repetitive rhythmic segments which are repetitions of the original rhythmic segments, the memory means stores musical data of the original rhythmic segments, and the control means starts reading musical data of corresponding original rhythmic segments when the music comes to the repetitive rhythmic segments, thereby eliminating identical data stored in the memory means.

7. An automatic music playing apparatus according to claim 1 wherein the memory means is provided with a plurality of storage regions, the regions being adapted to store musical data of respective rhythmic segments.

8. An automatic music playing apparatus according to claim 7 which further comprises an indicating means for indicating the storage region being read by the control means.

9. An automatic music playing apparatus according to claim 8 wherein the indicating means comprises a plurality of light emitting diodes provided in association with said plurality of storage regions.

10. An automatic music playing apparatus according to claim 8 wherein the indicating means comprises a plurality of light emitting diodes for emitting different colors from one to the other provided in association with said plurality of storage regions.

11. An automatic music playing apparatus according to claim 5 which further comprises a first indicating means for indicating the storage region being read by the control means and a second indicating means for indicating the preselected storage region specified by the specifying means.

12. An automatic music playing apparatus for automatically playing a piece of music in accordance with play data, said piece of music being composed of a predetermined number of consecutive segments having a rhythm, said apparatus comprising:
a storage means for storing said play data in a plurality of storage regions, each storage region having a plurality of storage locations;
a reading means for sequentially reading said play data out of said storage means, said reading means providing addresses of storage locations in said storage means;
a musical tone generating means for generating musical tones in accordance with said play data read out by said reading means;
a designating means for designating a storage region;
a detecting means for detecting a forthcoming rhythmic segment of said piece of music being played after activation of said designating means; and
an address changing means for changing said address to a first address of said storage locations of said storage region designated by said designating means at the time when said forthcoming rhythmic segment is detected by said detecting means, said designated storage locations differing from the first address of said forthcoming rhythmic segment.

13. An automatic music playing apparatus for automatically playing a piece of music in accordance with play data, said piece of music being composed of a predetermined number of consecutive segments having a rhythm, said apparatus comprising:
a storage means for storing said play data in a plurality of storage regions, each storage region having a plurality of storage locations;
a reading means for sequentially reading said play data out of said storage means, said reading means providing addresses of storage locations;
a musical tone generating means for generating musical tone in accordance with said play data read out by said reading means;
an operation means for designating a predetermined address;
a detecting means for detecting a forthcoming rhythmic segment of said piece of music being played activation of said operation means; and
an address changing means for changing said address to said predetermined address at the time when said forthcoming rhythmic segment is detected by said detecting means, said predetermined address differing from the first address of said forthcoming rhythmic segment.

* * * * *